US008803742B2

(12) United States Patent
Sharawi et al.

(10) Patent No.: US 8,803,742 B2
(45) Date of Patent: Aug. 12, 2014

(54) DUAL-BAND MIMO ANTENNA SYSTEM

(75) Inventors: Mohammad S. Sharawi, Dhahran (SA); Mohammad Azam Jan, Dhahran (SA)

(73) Assignee: King Fahd University of Petroleum and Minerals, Dhahran (SA)

( * ) Notice: Subject to any disclaimer, the term of this patent is extended or adjusted under 35 U.S.C. 154(b) by 191 days.

(21) Appl. No.: 13/418,177

(22) Filed: Mar. 12, 2012

(65) Prior Publication Data

US 2013/0234896 A1 Sep. 12, 2013

(51) Int. Cl.

| | |
|---|---|
| ***H01Q 1/38*** | (2006.01) |
| ***H01Q 21/08*** | (2006.01) |
| ***H01Q 1/48*** | (2006.01) |

(52) U.S. Cl.
USPC ..... 343/700 MS; 343/826; 343/846

(58) Field of Classification Search
USPC ..... 343/700 MS, 826, 846
See application file for complete search history.

(56) References Cited

U.S. PATENT DOCUMENTS

| | | | | |
|---|---|---|---|---|
| 2008/0094302 | A1* | 4/2008 | Murch et al. | 343/846 |
| 2008/0158064 | A1* | 7/2008 | Ponce De Leon et al. | 343/700 MS |
| 2009/0066580 | A1 | 3/2009 | Tseng et al. | |
| 2011/0018780 | A1* | 1/2011 | Tassoudji et al. | 343/844 |
| 2012/0092220 | A1* | 4/2012 | Tani et al. | 343/702 |
| 2012/0139793 | A1* | 6/2012 | Sharawi | 343/700 MS |
| 2013/0002510 | A1* | 1/2013 | Azulay et al. | 343/860 |

OTHER PUBLICATIONS

Ki-Jin Kim, Won-Gyu Dim and Jong-Won Yu, "High Isolation Internal Dual-Band Planar Inverted-F Antenna Diversity System with Band-Notched Slots for MIMO Terminals", *Microwave Conference, 2006. 36th European*, Sep. 10-15, 2006, pp. 1414-1417.

Yang, C., Kim, J., Kim, H., Wee, J. Kim, B. and Jung, C., "Quad-Band Antenna With High Isolation MIMO and Broadband SCS for Broadcasting and Telecommunication Services", *Antennas and Wireless Propagation Letters, IEEE*, vol. 9, pp. 584-587, 2010.

* cited by examiner

*Primary Examiner* — Jacob Y Choi
*Assistant Examiner* — Daniel J Munoz
(74) *Attorney, Agent, or Firm* — Richard C. Litman

(57) ABSTRACT

The dual-band MIMO antenna system includes antenna elements arranged on a printed circuit board. For the plurality of antennas on the board, the opposing antennae are arranged in mirror-image fashion. Each antenna has a first elongate vertical element connected to and extending vertically from one end of a horizontal element. A second, shorter elongate vertical element is disposed proximate an opposite end of the horizontal element and extends upward therefrom in parallel with the first elongate member. First (feed) and second (short) stubby vertical elements are disposed on the horizontal element proximate the second elongate member and extend downward from the horizontal element. A ground plane is formed on the opposite face of the printed circuit board.

8 Claims, 20 Drawing Sheets

300a

300b

500a

1000a

1000b

1200a

DUAL-BAND MIMO ANTENNA SYSTEM

BACKGROUND OF THE INVENTION

1. Field of the Invention

The present invention relates to mobile handset antenna systems, and particularly to a dual-band MIMO antenna system having antenna elements arranged in a unique geometric configuration.

2. Description of the Related Art

Long Term Evolution (LTE) is the next generation of cellular technology and will evolve from the current Universal Mobile Telecommunication System/High Speed Packet Access (UMTS/HSPA). The LTE standard will provide higher peak data rates, higher spectral efficiency, lower latency, flexible channel bandwidths, and lower system cost. LTE is considered the fourth generation (4G) in mobile communications. It is referred to as MAGIC; Mobile Multimedia, Anywhere anytime, with Global mobility support, Integrated wireless solution, and Customized personal service. LTE will be based on the Internet Protocol (IP) and provide higher throughput, broader bandwidth, and better handoff to realize seamless services across covered areas.

The service targets promised by LTE will be made possible by utilizing the latest advances in adaptive modulation and coding (AMC), multiple-input-multiple-output systems (MIMO), and adaptive antenna arrays. The target for spectral efficiency (max. data rate/max. channel BW) of LTE is 300 Mbps/20 MHz=15 bits/Hz (with the use of MIMO capability), which is 6 times higher compared with the current 3G-based networks. Orthogonal frequency division multiple access (OFDMA) will be used in the new air interface for the LTE radio access network (RAN). OFDM converts a frequency-selective fading channel into multiple flat fading subchannels, facilitating easy equalization, while MIMO helps in increasing the throughput.

Multiple antenna systems (Multiple Input, Multiple Output—MIMO) give significant enhancement to data rate and channel capacity. It has been shown that the capacity of MIMO systems increases linearly with the number of transmit or receive antennas under the assumption that the number of transmit antennas and receive antennas are identical. A key feature of MIMO systems is that it turns multipath propagation, which is a pitfall of wireless transmission, into a benefit for the user. MIMO effectively takes advantage of random fading and multipath delay spread for enhancing the data rate. The possibility of many orders of magnitude improvement in wireless communication performance at no cost of extra spectrum (only hardware and complexity are added) has turned MIMO into an active topic for new research.

"Printed antennas" is a generic term that includes the ever-increasing constructional variations that printed circuit board technology makes possible. The basic microstrip or printed antenna configuration resembles a printed circuit board (PCB), consisting of a thin substrate having both sides coated with copper film. Printed transmission lines, patches etc., are produced on one side of the board, and the other copper-clad surface is used as the ground plane. An electromagnetic wave is launched and allowed to spread in between the printed structure and the ground plane. Such a structure has great advantages, such as low profile, low cost, light weight, ease of fabrication, and suitability to conform on curved surfaces. All of these advantages have made microstrip technology attractive since the early phase of its development. Despite the previously mentioned features, microstrip patch antennas suffer from several inherent disadvantages of this technology in its pure form, namely, such patch antennas have small bandwidth and relatively poor radiation efficiency resulting from surface wave excitation and conductor and dielectric losses. Also, to accurately predict the performance of this form of radiator, and in particular, to predict its input impedance nature, typically a full-wave, computationally intensive numerical analysis is required.

Microstrip and printed antennas have been increasingly used for personal wireless applications. Due to their low profile, compatibility with Integrated Circuit technology and conformability to shaped surfaces, they are suitable for use as embedded antennas in handheld wireless devices. Theoretical and experimental research on microstrip and printed antennas has continued since the 1970s and has resulted in a remarkable change in antenna design, and in producing multifunction configurations with simple construction and low manufacturing cost.

Modern wireless systems have to provide higher and higher data rates, as required by new applications. Since increasing the bandwidth is expensive and there is limit to using higher order modulation types, new methods for utilizing the transmission channel have to be used. MIMO systems use multiple antennas at both the transmitter and receiver sides of the communication link to increase the capacity of the channel. Multiple antennas can easily be deployed at a base station because there is no strict limitation on the size. However, implementing multiple antennas on a small mobile terminal is challenging, since there is not much space available for multiple antennas on a small mobile terminal, such as a handset or PDA.

Therefore, a multiple-element antenna system should be small in order to be embedded into the small mobile terminal. It also should meet some additional requirements, such as low cost, reliability, good isolation and diversity performance for multiple antennas, in addition to being compact, lightweight, low profile, and robust.

Thus, a dual-band MIMO antenna system solving the aforementioned problems is desired.

SUMMARY OF THE INVENTION

The dual-band MIMO antenna system includes antenna elements arranged on a printed circuit board. For the plurality of antennas on the board, the opposing antennae are arranged in mirror-image fashion. Each antenna has a first elongate vertical element connected to and extending vertically from one end of a horizontal element. A second, shorter elongate vertical element is disposed proximate an opposite end of the horizontal element and extends upward therefrom in parallel with the first elongate member. First (feed) and second (short) stubby vertical elements are disposed on the horizontal element proximate the second elongate member and extend downward from the horizontal element. The various parameters of the antenna, such as the length of the vertical arms ($L_1$, $L_2$) and the horizontal portion ($L_f$), the height above the ground plane (h1,h), the position of the short ($X_s$), and the position of the feed point ($X_f$) can be used to control the antenna resonant frequencies and bandwidth.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The dual-band MIMO antenna system includes antenna elements arranged on a printed circuit board, i.e., a microstrip patch antenna. For the plurality of antennas on the board, the opposing antennae are arranged in mirror image fashion. The dual-band MIMO antenna system utilizes microstrip antennas constructed of copper-clad strips on a face of a dielectric substrate, such as a printed circuit board. The antennas are dimensioned and configured to fit within the housing of a handheld MIMO device, such as a mobile or portable radio or cellular telephone. Each embodiment is configured for communication on at least two different frequency bands. Each MIMO antenna array includes at least one pair of antennas. A single array or installation may include multiple pairs of antennas.

Figure 1:
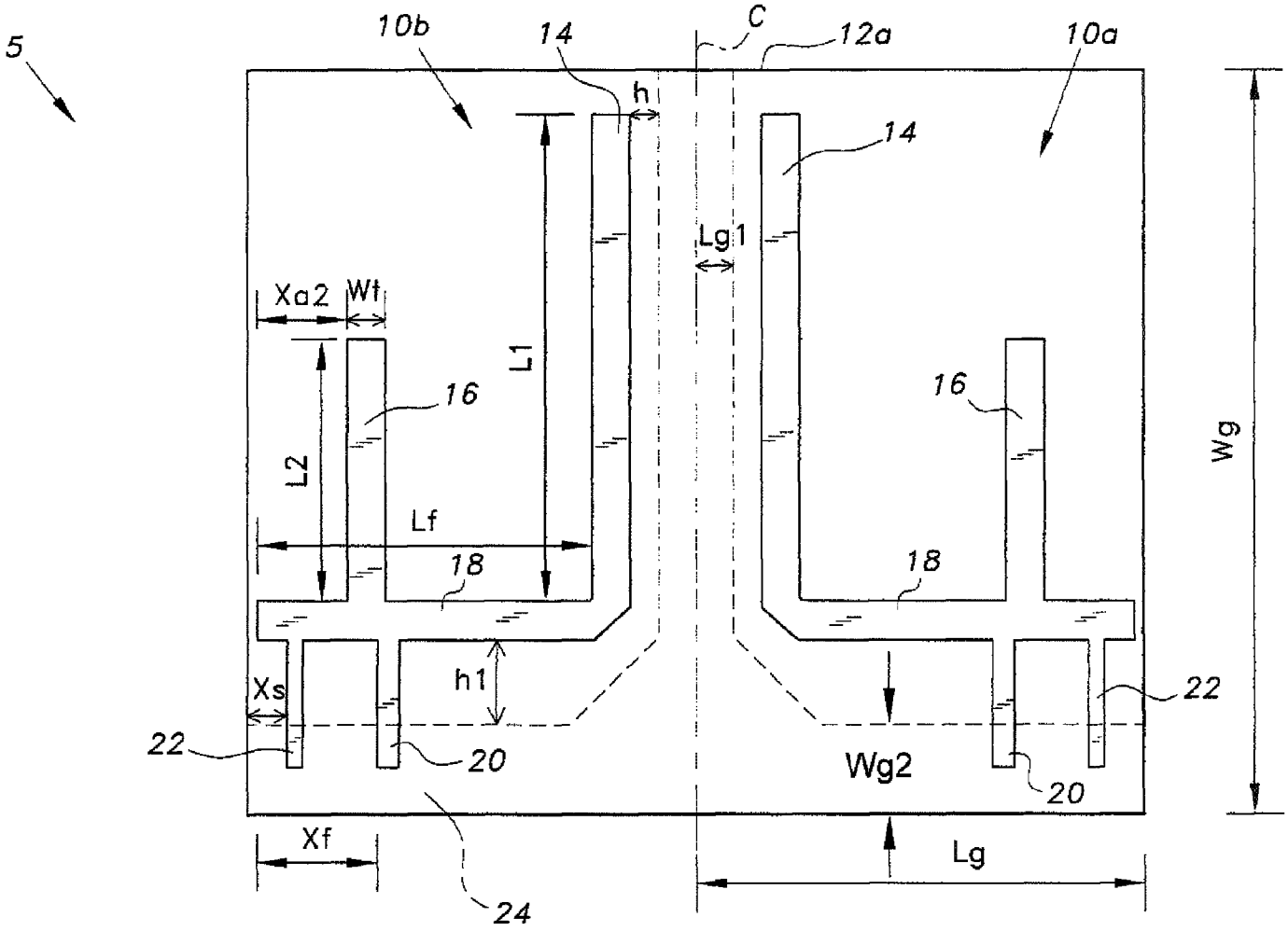
FIG. 1 is a top view of a MIMO antenna system according to the present invention.

FIG. 1 shows an exemplary dual-band MIMO antenna system 5 having two identical exemplary antennas 10*a* and 10*b* arranged in mirror image from each other. In the system 5 and in the orientation shown in FIG. 1, each exemplary antenna 10*a*, 10*b* has a first elongate vertical element 14 connected to and extending vertically from one end of a horizontal element 18. A second, shorter elongate vertical element 16 is disposed proximate an opposite end of the horizontal element 18 and extends upward therefrom in parallel with the first elongate member 14. Referring to antenna 10*b*, the vertical elements 14, 16 and the horizontal element 18 are essentially an inverted "F" antenna rotated 90° counterclockwise, and antenna 10*a* is its mirror image. First and second stubby vertical elements 20, 22 are disposed on horizontal element 18 proximate second elongate member 16 and extend downward from the horizontal element 18, in a direction opposite vertical element 16. The first stubby element 20 is the feed element, and is disposed between the vertical elements 14 and 16, but extends in the opposite direction. The second stubby element 22 is the short element, and is disposed between the vertical element 16 and the free end of the horizontal element 18, but extends in a direction opposite vertical element 16. As most clearly shown in FIG. 1, in antenna 10*a*, the first stubby vertical element 20 has a first edge disposed to the left of an edge of the second, shorter elongate vertical element 16 facing the first, longer elongate vertical element 14. The first stubby vertical element 20 also has a second edge disposed to the right of the same edge of the second, shorter elongate vertical element 16. The dashed lines in FIG. 1 indicate the borders of the ground plane on the bottom face of the board. The ground plane does not lie directly beneath the vertical elements 14, 16 and the horizontal element, but includes an elongated portion extending between the vertical legs 14 of antenna 10*a* and antenna 10*b*, which joins another elongate portion that extends parallel to the horizontal leg 18 of antenna 10*a* and antenna lob.

The various parameters of the antenna system 5, such as the length of the vertical arms (L1, L2) and horizontal portion (Lf), the height above the ground plane (h1,h), the position of the short (Xs) (the distance between the short 22 and the end of the ground plane), and the position of the feed point (Xf)

(the distance between the feed element 20 and the end of the horizontal element 18), the width of the short (Ws), the width of the feed (Wf), the thickness (D) of the PCB, and other parameters shown in FIG. 1, can be used to control the antenna resonant frequencies and bandwidth. Typical parameter values are shown in Table 1.

TABLE 1

2 × 1 MIMO Antenna Parameters

| Parameter | Value | Parameter | Value |
|---|---|---|---|
| Wg | 50 mm | Xf | 6 mm |
| Lg | 33.5 mm (from centerline c to edge of ground plane) | H | 2 mm |
| Lg1 | 10 mm | Wt | 2.2 mm |
| Wg2 | 5 mm | D | 1.56 mm |
| L1 | 38 mm | Lf | 19.5 mm |
| L2 | 26 mm | Wf | 2.5 mm |
| Ws | 1 mm | Xs | 1.5 mm |
| Xa2 | 5 mm | h1 | 3.5 mm |

Figure 2A:
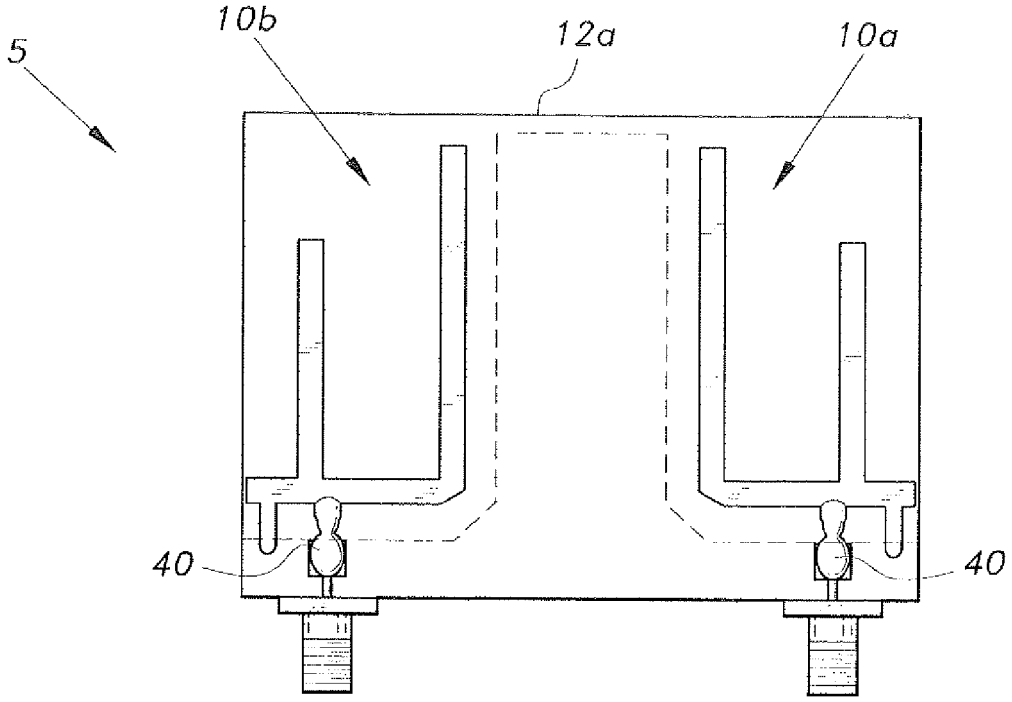
FIG. 2A is a top view of the MIMO antenna system of FIG. 1 with coax connectors connected thereto for testing the antenna.
Figure 2B:
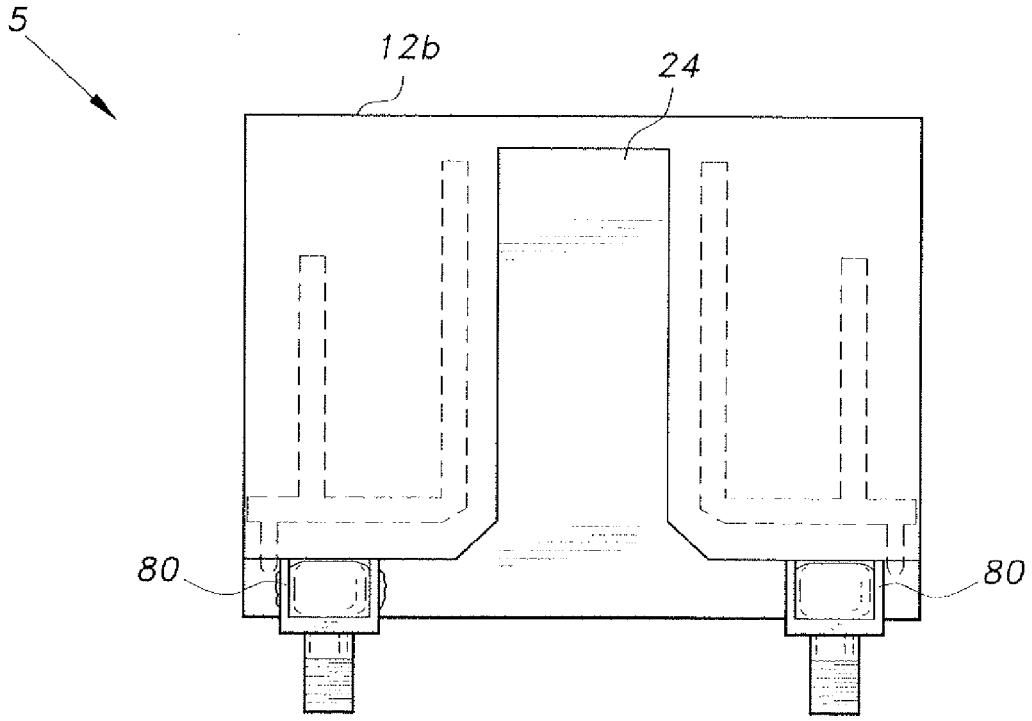
FIG. 2B is a bottom view of the MIMO antenna system of FIG. 2A.
Figure 3A:
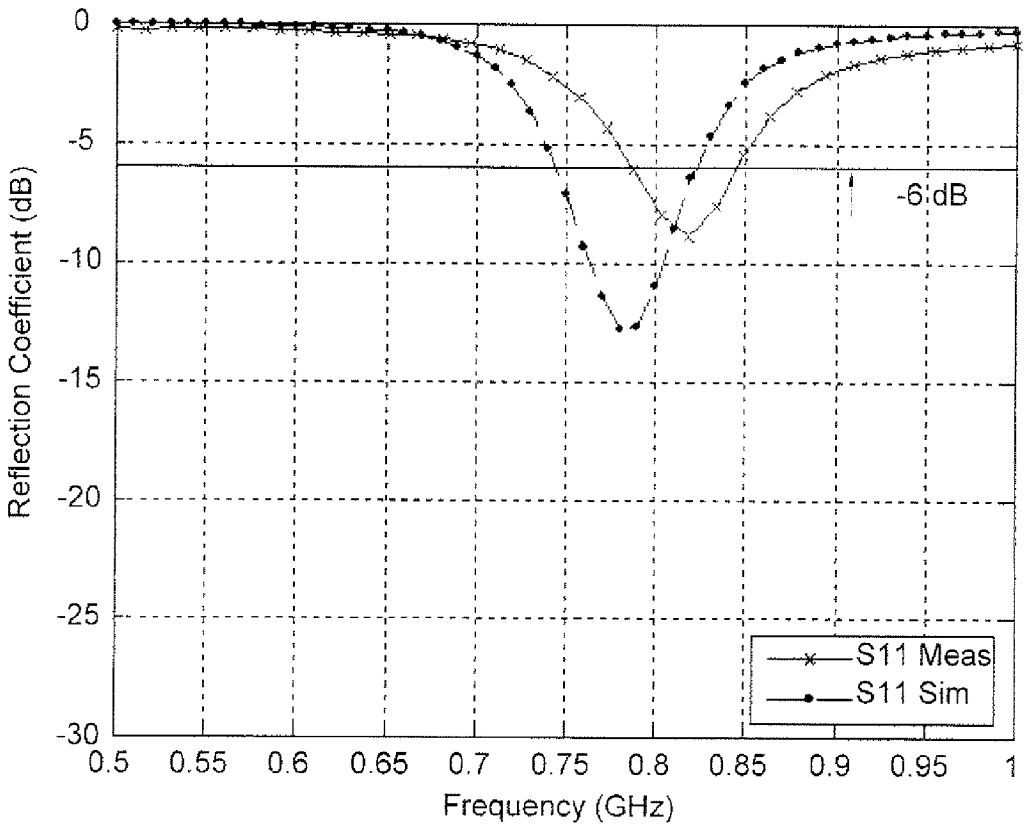
FIG. 3A is a plot showing simulated and measured S11 reflection coefficients for the MIMO antenna system of FIGS. 2A and 2B for the low band.
Figure 3B:
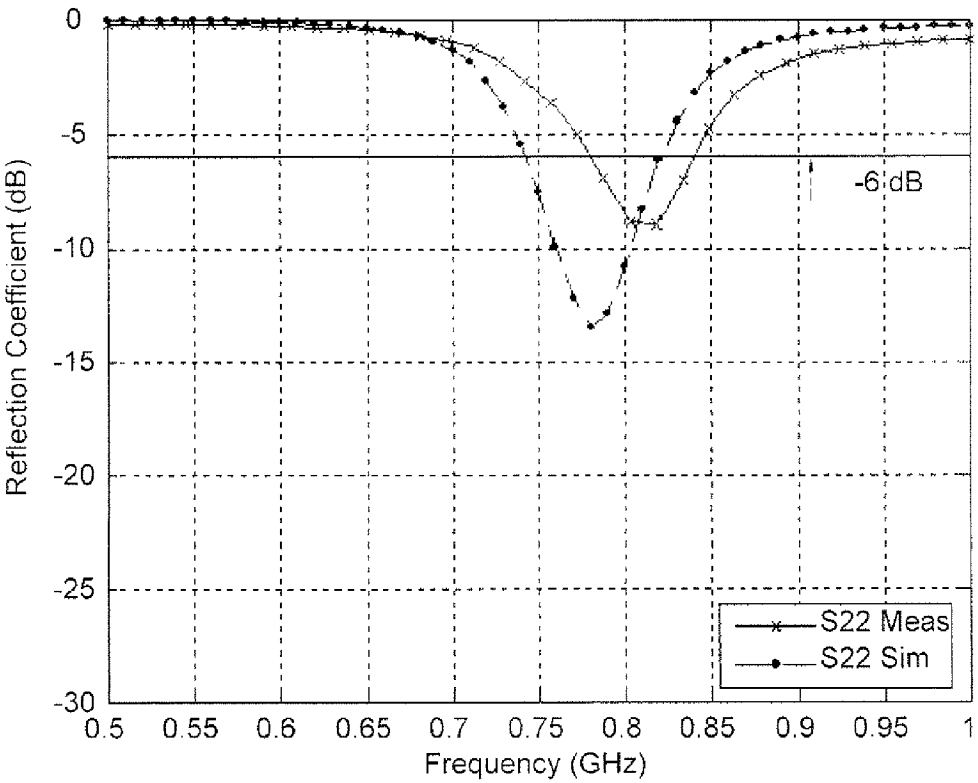
FIG. 3B is a plot showing simulated and measured S22 reflection coefficients for the MIMO antenna system of FIGS. 2A and 2B for the low band.
Figure 4A:
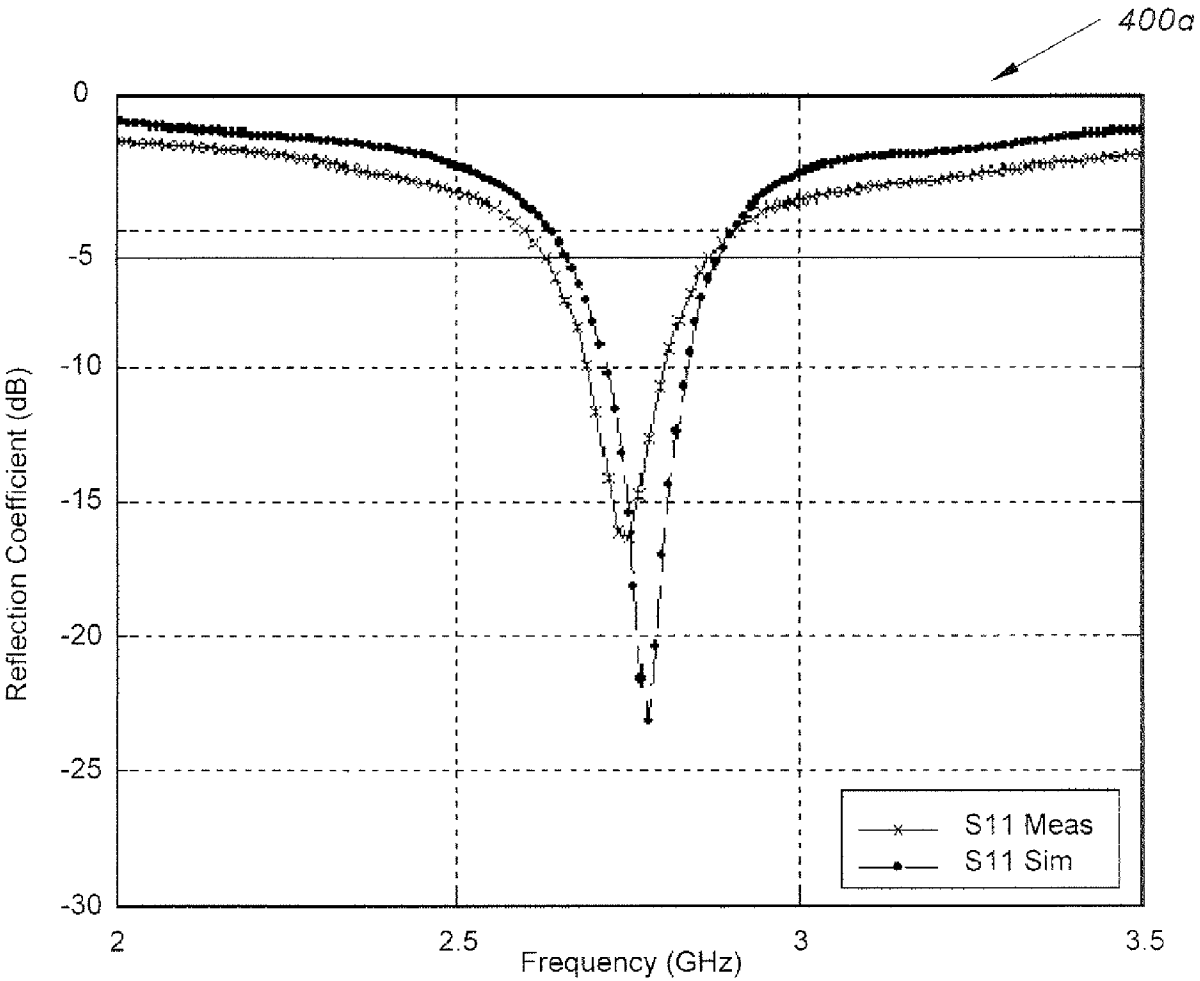
FIG. 4A is a plot showing simulated and measured S11 reflection coefficients for the MIMO antenna system of FIGS. 2A and 2B for the high band.
Figure 4B:
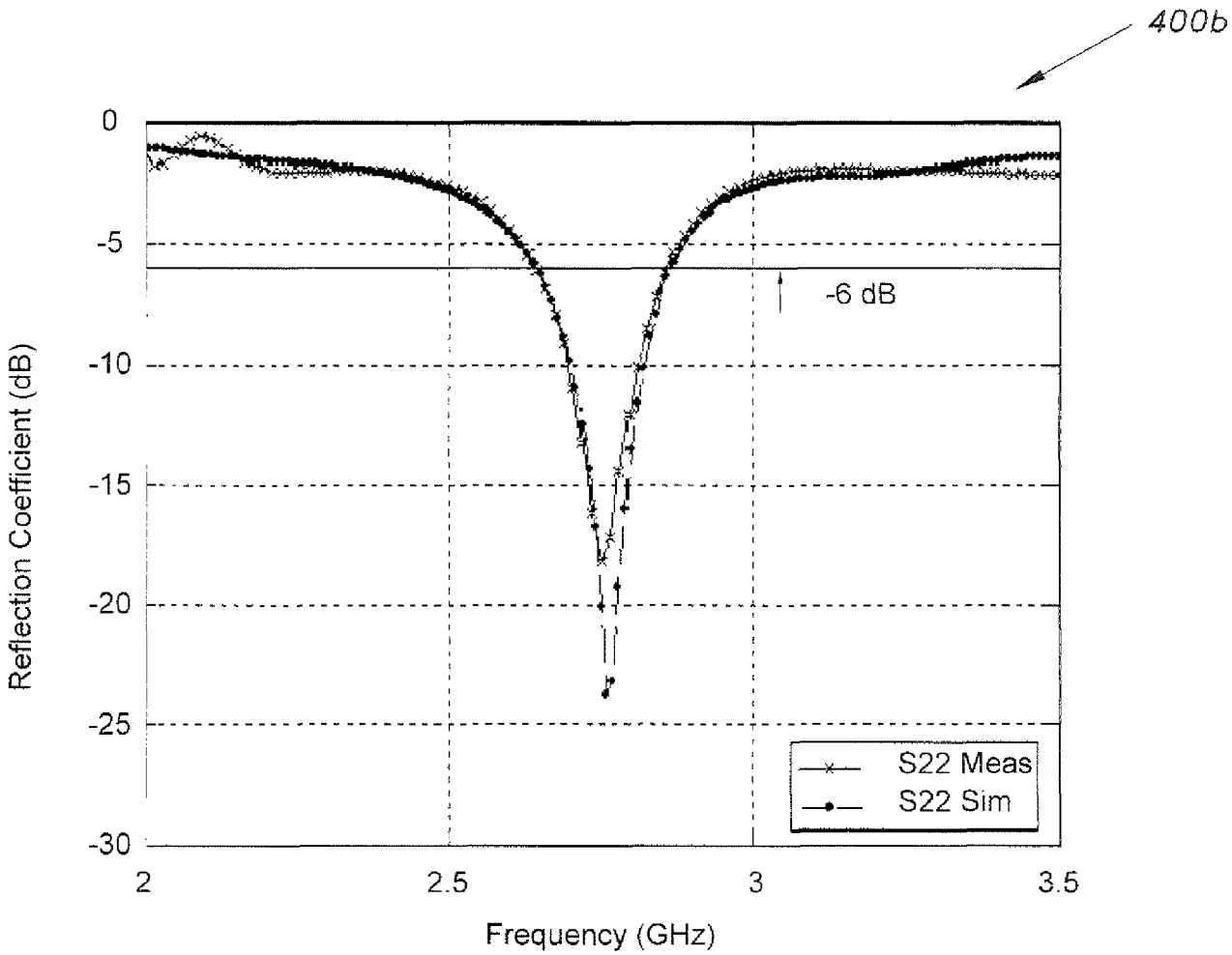
FIG. 4B is a plot showing simulated and measured S22 reflection coefficients for the MIMO antenna system of FIGS. 2A and 2B for the high band.

FIGS. 2A and 2B show an implementation of the dual-band MIMO antenna system 5 that is printed on 1.56 mm thick FR-4 substrate to achieve a lower resonance frequency. The system antennas 10*a* and 10*b* are printed on the top face 12*a* of the dielectric material substrate (sometimes referred to herein as an antenna board). Although the exemplary thickness of the substrate is 1.56 mm, other thicknesses can be used given that the thicknesses and lengths of the antenna elements are adjusted to cover the bands of frequencies needed.

The ground plane 24, as most clearly shown in FIG. 2B is a planar strip disposed on the bottom face 12*b* of the antenna board and runs parallel to horizontal antenna elements 18 while extending upward to run parallel to and beside antenna elements 14. In the 2×1 antenna configuration 5, the ground plane 24 is substantially T shaped, or in effect, each points 40 connected to ends of elements 20 and are impedance-matched to the feeding cable or transmission line impedance. The ends of elements 22 are shorted to the ground plane 24 at short connector points 80. The feed connectors shown are coaxial SMA connectors. The MIMO antenna array of FIGS. 2A and 2B was implemented with coaxial connectors to facilitate testing. Although some practical implementations of the antenna system of FIG. 1 may also have coaxial connectors and use coaxial transmission cable lines (e.g., an RF dongle), other practical implementations will have transmission lines (e.g., microstrip transmission lines) that depend upon the application (e.g., a cellular telephone).

The MIMO antenna array of FIGS. 2A and 2B is a dual band array in which both antennas 10*a* and 10*b* are configured to resonate at 815 MHz (the low band) and at 2.75 GHz (the high band). The experimental performance measurements are shown in Table 2. In Table 2, "Antenna Element" 1 refers to antenna 10*a* of FIG. 2A, and "Antenna Element" 2 refers to antenna 10*b* of FIG. 2A.

TABLE 2

Measurement Results for the 2 × 1 MIMO Antenna

| Model/ Parameter | Band | Antenna Element | BW (−6 dB) | BW (−10 dB) | $S_{xx}$ | $S_{21}$ | f1 (−6 dB) | f2 (−6 dB) |
|---|---|---|---|---|---|---|---|---|
| 2 × 1 | Low | 1 | 59 | 0 | −9 | −6.5 | 786 | 845 |
| MIMO | | 2 | 60 | 0 | −9 | | 780 | 840 |
| model | High | 1 | 239 | 112 | −16 | −10.5 | 2630 | 2869 |
| (1.56 mm) | | 2 | 216 | 115 | −18 | | 2642 | 2858 |

As shown in reflection coefficient plots 300*a*, 300*b* and 400*a*, 400*b* of FIGS. 3A-3B and 4A-4B, respectively, the dual-band MIMO antenna system 5 provides a lower resonance frequency for both the low and high frequency bands. The −6 dB bandwidth (BW) with a center frequency of 815 MHz was about 60 MHz, while in the high band centered at 2.75 GHz, it was about 200 MHz.

with a center frequency of 815 MHz was about 60 MHz, while in the high band centered at 2.75 GHz, it was about 200 MHz.

Figure 5A:
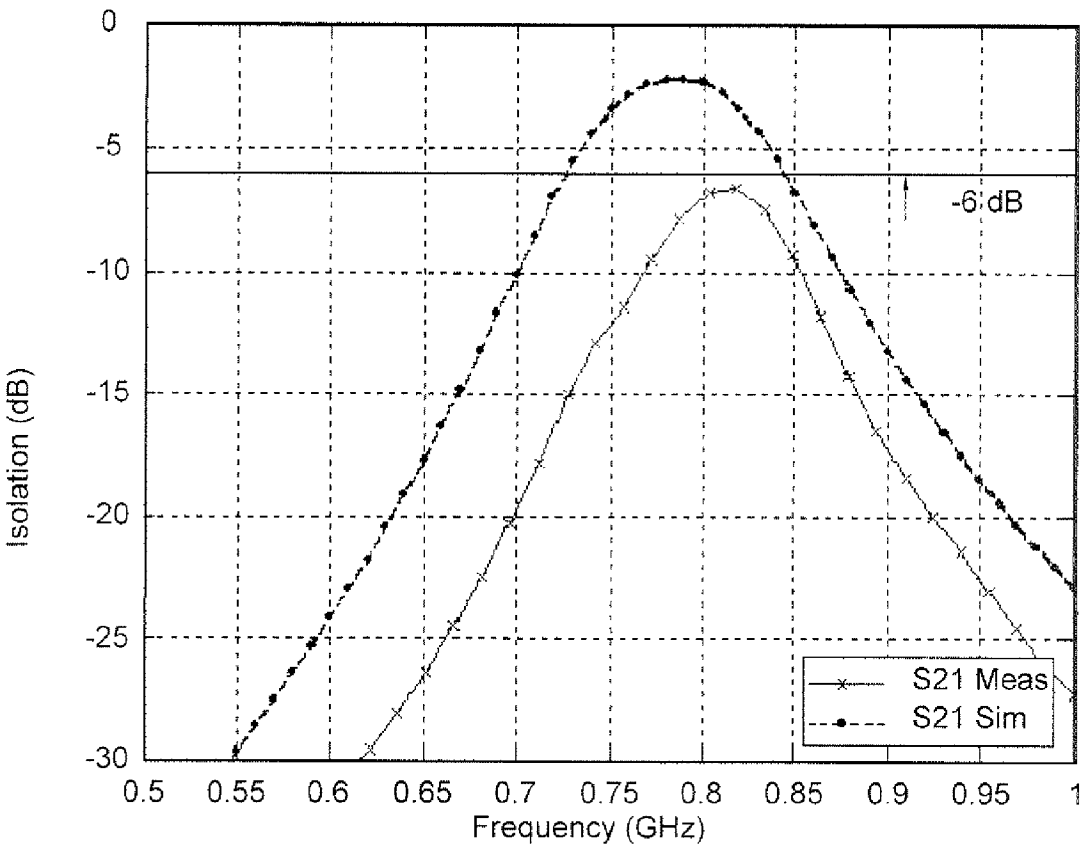
FIG. 5A is a plot showing simulated and measured S21 isolation for the MEMO antenna system of FIGS. 2A and 2B for the low band.
Figure 5B:
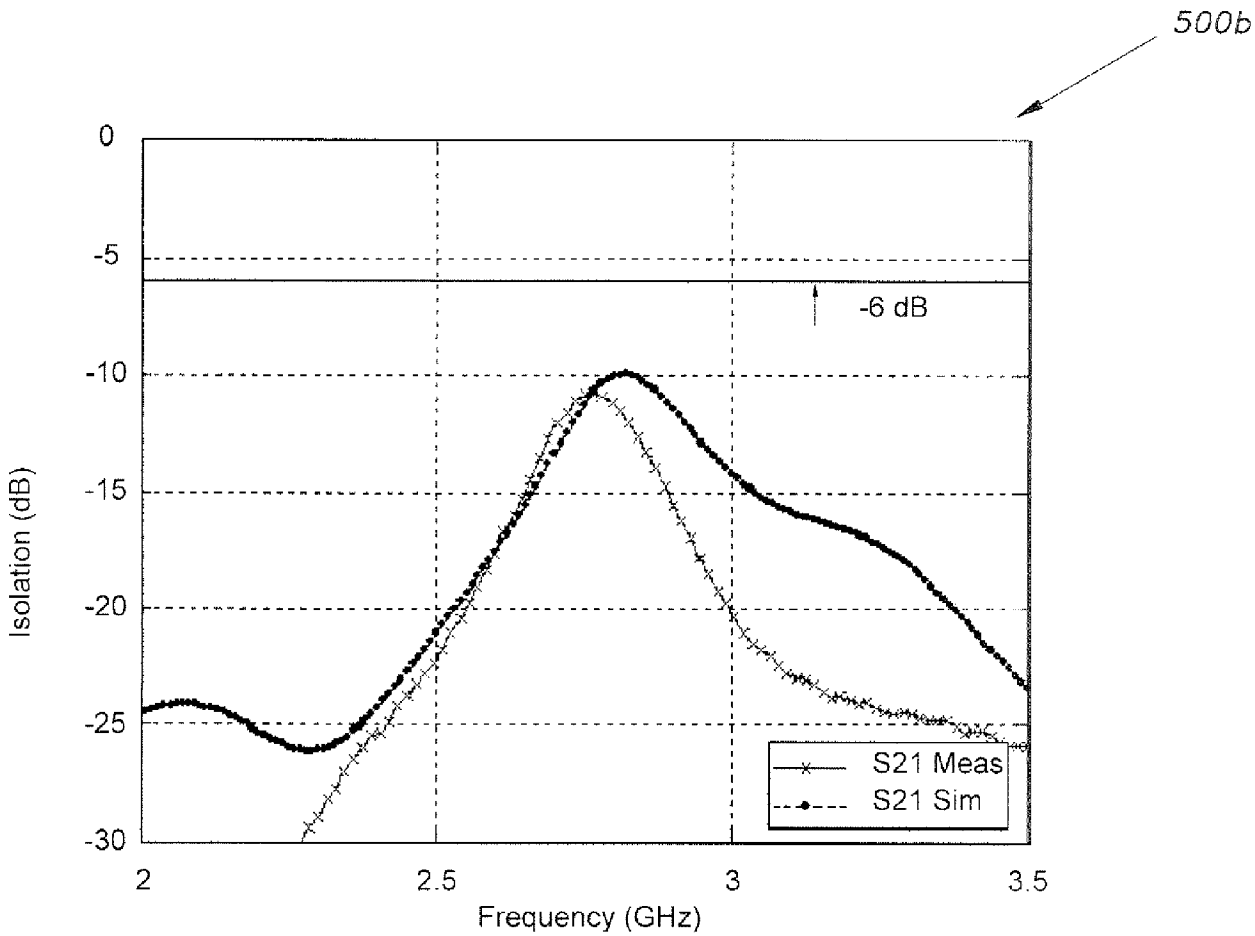
FIG. 5B is a plot showing simulated and measured S21 isolation for the MIMO antenna system of FIGS. 2A and 2B for the high band.
Figure 6A:
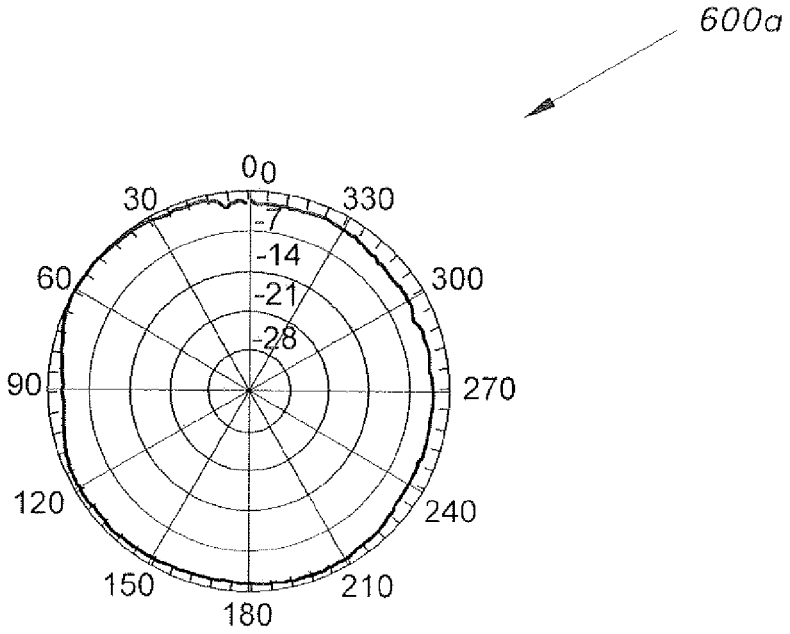
FIG. 6A is a plot showing x-z (elevation) plane pattern for element 1 for the MIMO antenna system of FIGS. 2A and 2B at 800 MHz.
Figure 6B:
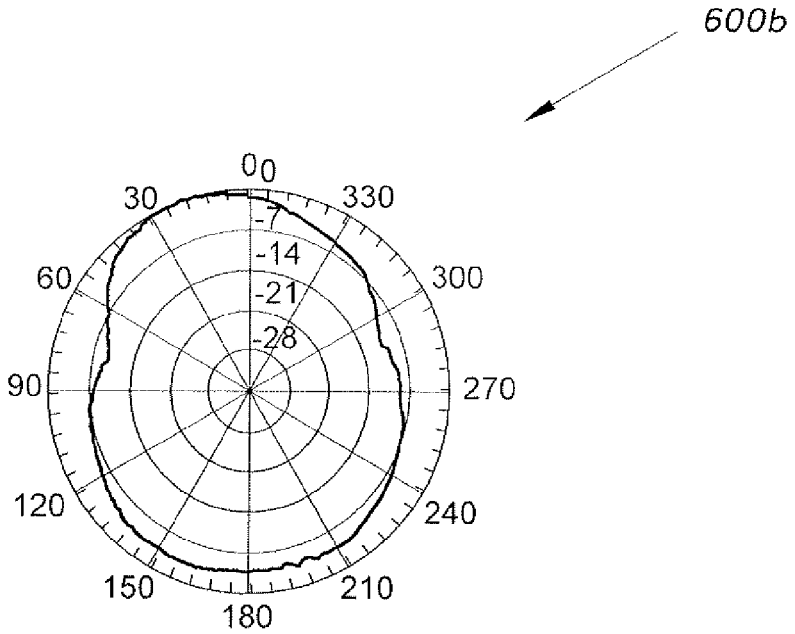
FIG. 6B is a plot showing x-z (elevation) plane pattern for element 2 for the MIMO antenna system of FIGS. 2A and 2B at 800 MHz.
Figure 7A:
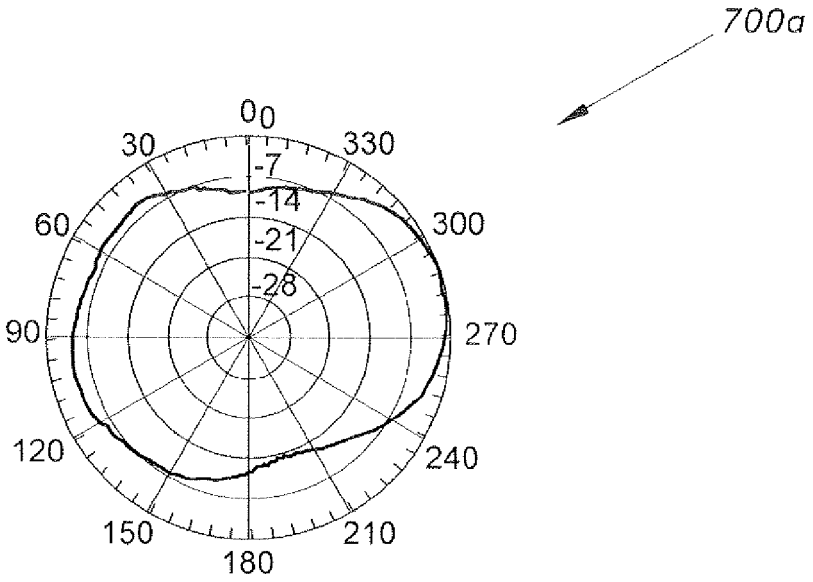
FIG. 7A is a plot showing x-y (azimuth) plane pattern for element 1 for the MIMO antenna system of FIGS. 2A and 2B at 800 MHz.
Figure 7B:
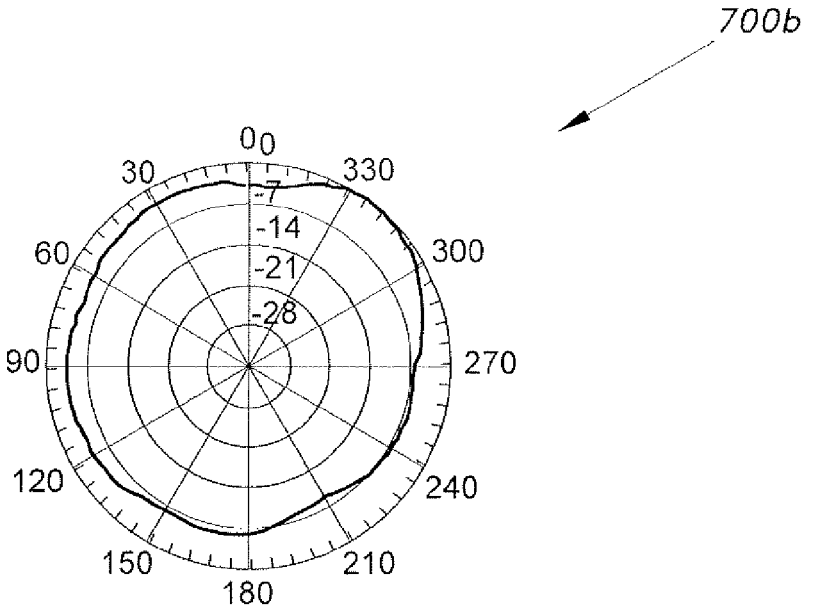
FIG. 7B is a plot showing x-y (azimuth) plane pattern for element 2 for the MIMO antenna system of FIGS. 2A and 2B at 800 MHz.

Isolation plots 500*a* and 500*b*, shown in FIGS. 5A-5B, demonstrate that the isolation remained at a value of about −6.5 dB in the lower band and −11 dB in the high band. The normalized gain patterns 600*a*, 600*b* and 700*a*, 700*b* are shown in FIGS. 6A-6B and FIGS. 7A-7B for the elevation and azimuth planes, respectively.

Figure 8:
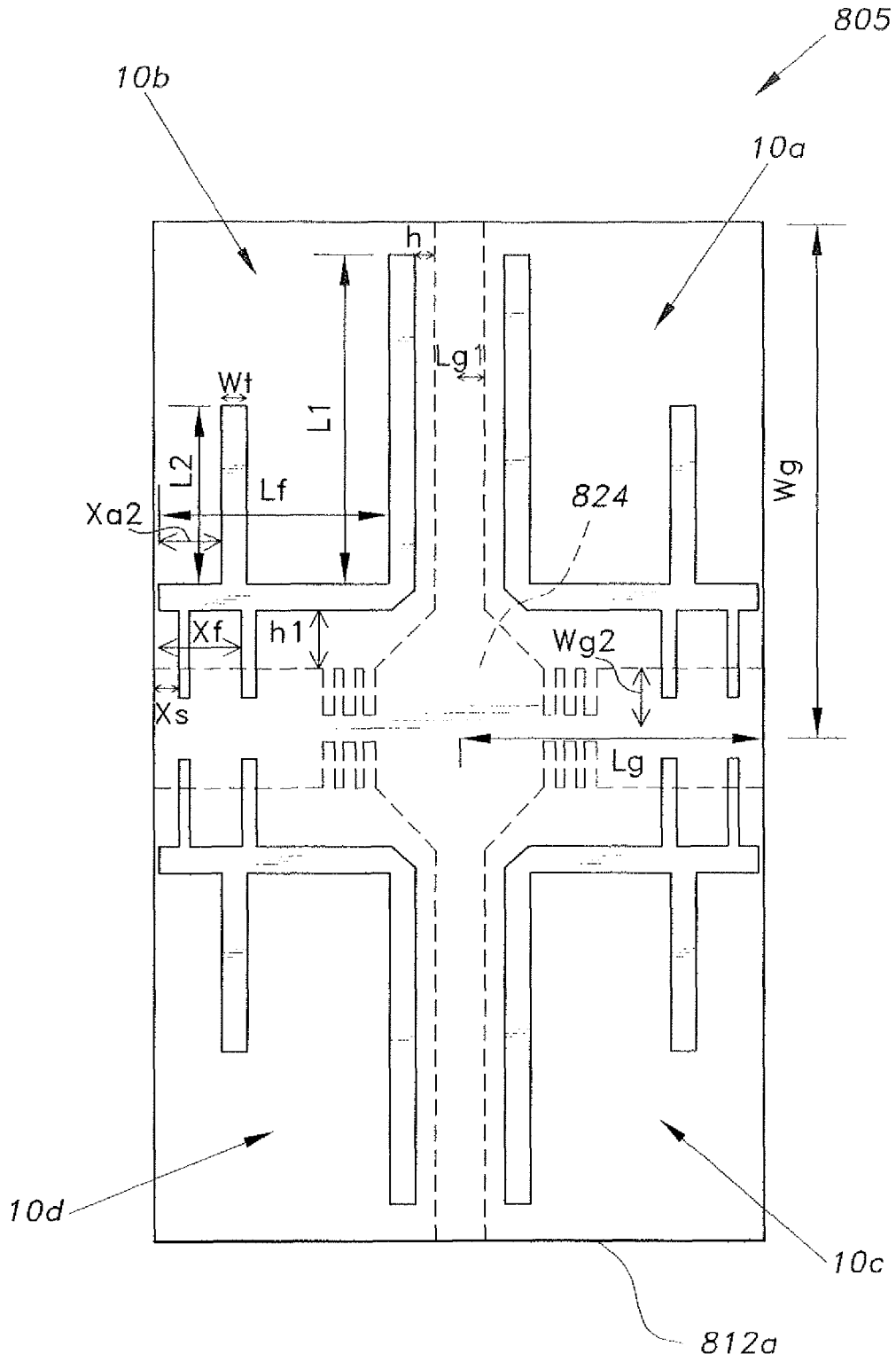
FIG. 8 is a top view of a 2×2 MIMO antenna according to the present invention.
Figure 9A:
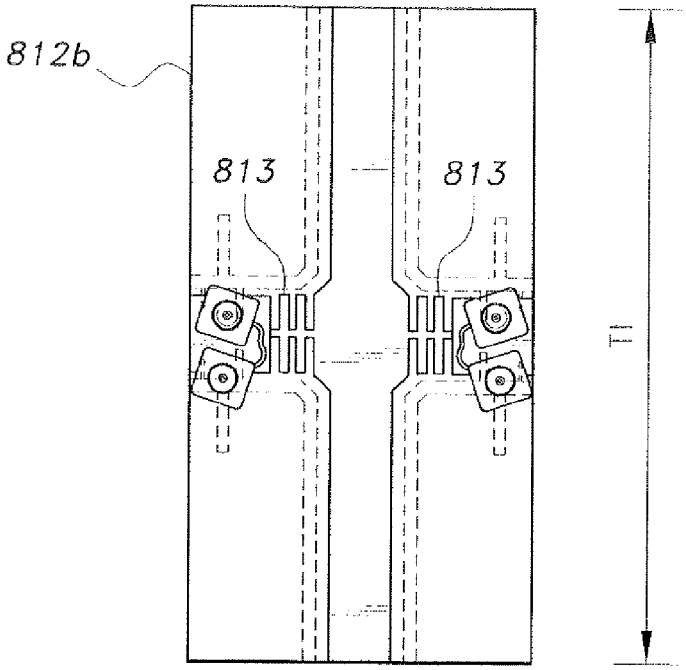
FIG. 9A is a bottom view of the 2×2 MIMO antenna of FIG. 8 with coax connectors connected thereto for testing the antenna.
Figure 9B:
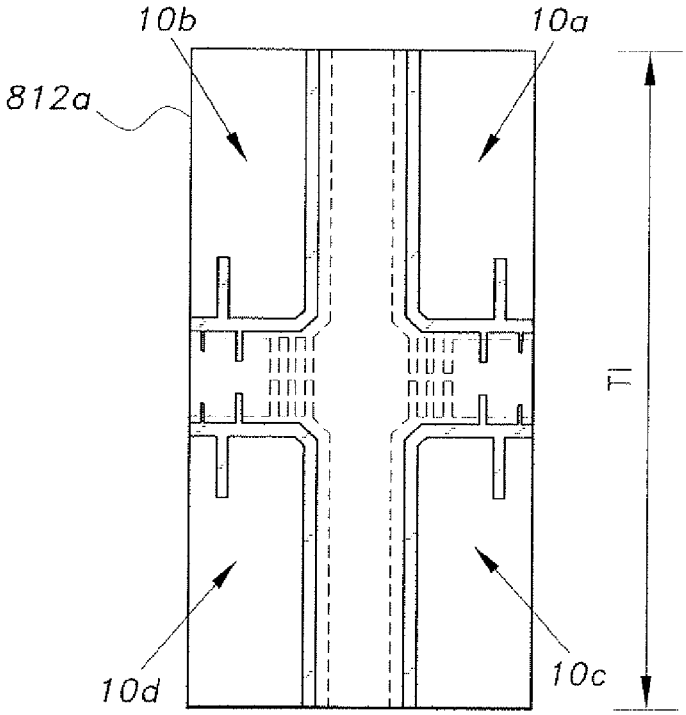
FIG. 9B is a top view of the 2×2 MIMO antenna of FIG. 8 with coax connectors connected thereto for testing the antenna.
Figure 10A:
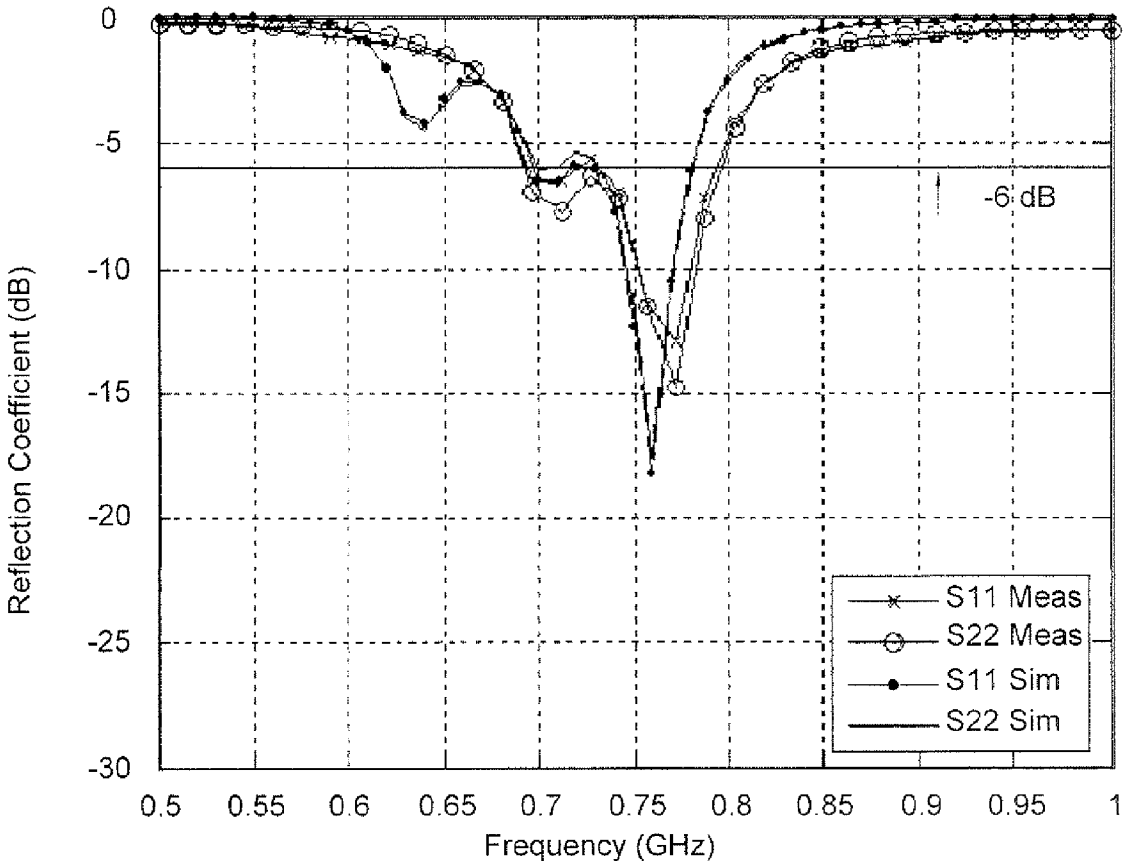
FIG. 10A is a plot showing S11 and S22 reflection coefficients for all elements of the 2×2 MIMO antenna of FIGS. 9A and 9B for the low band.
Figure 10B:
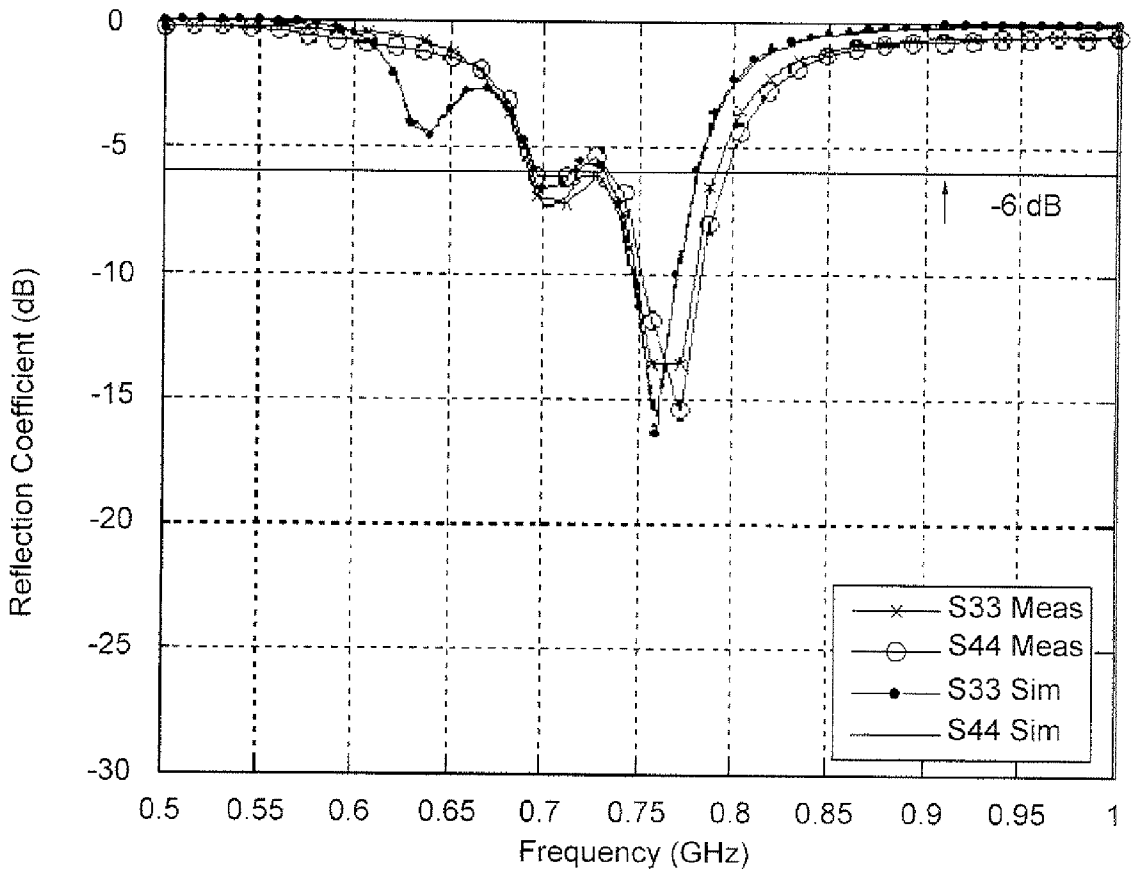
FIG. 10B is a plot showing S33 and S44 reflection coefficients for all elements of the 2×2 MIMO antenna of FIGS. 9A and 9B for the low band.
Figure 11A:
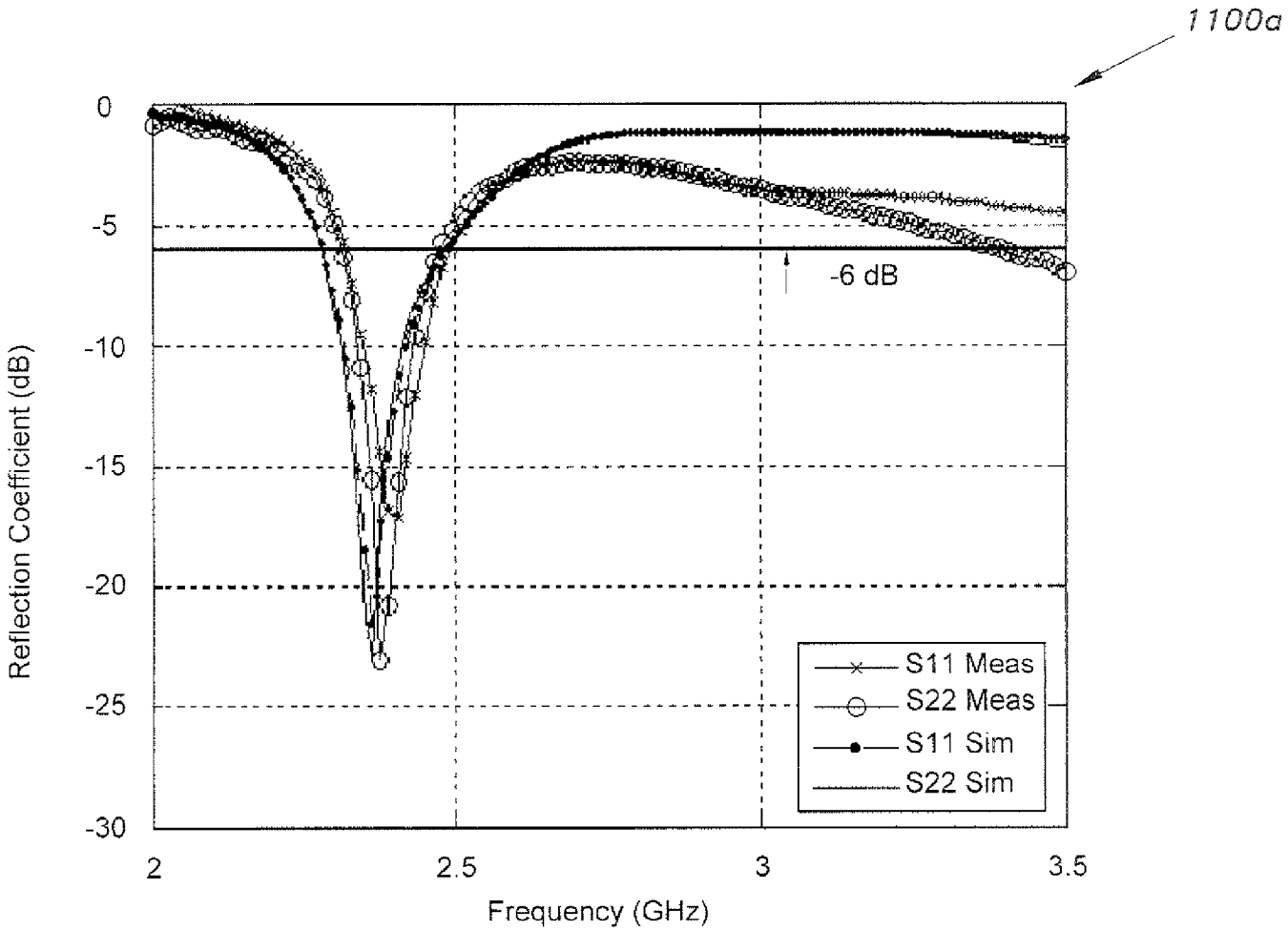
FIG. 11A is a plot showing S11 and S22 reflection coefficients for all elements of the 2×2 MIMO antenna of FIGS. 9A and 9B for the high band.
Figure 11B:
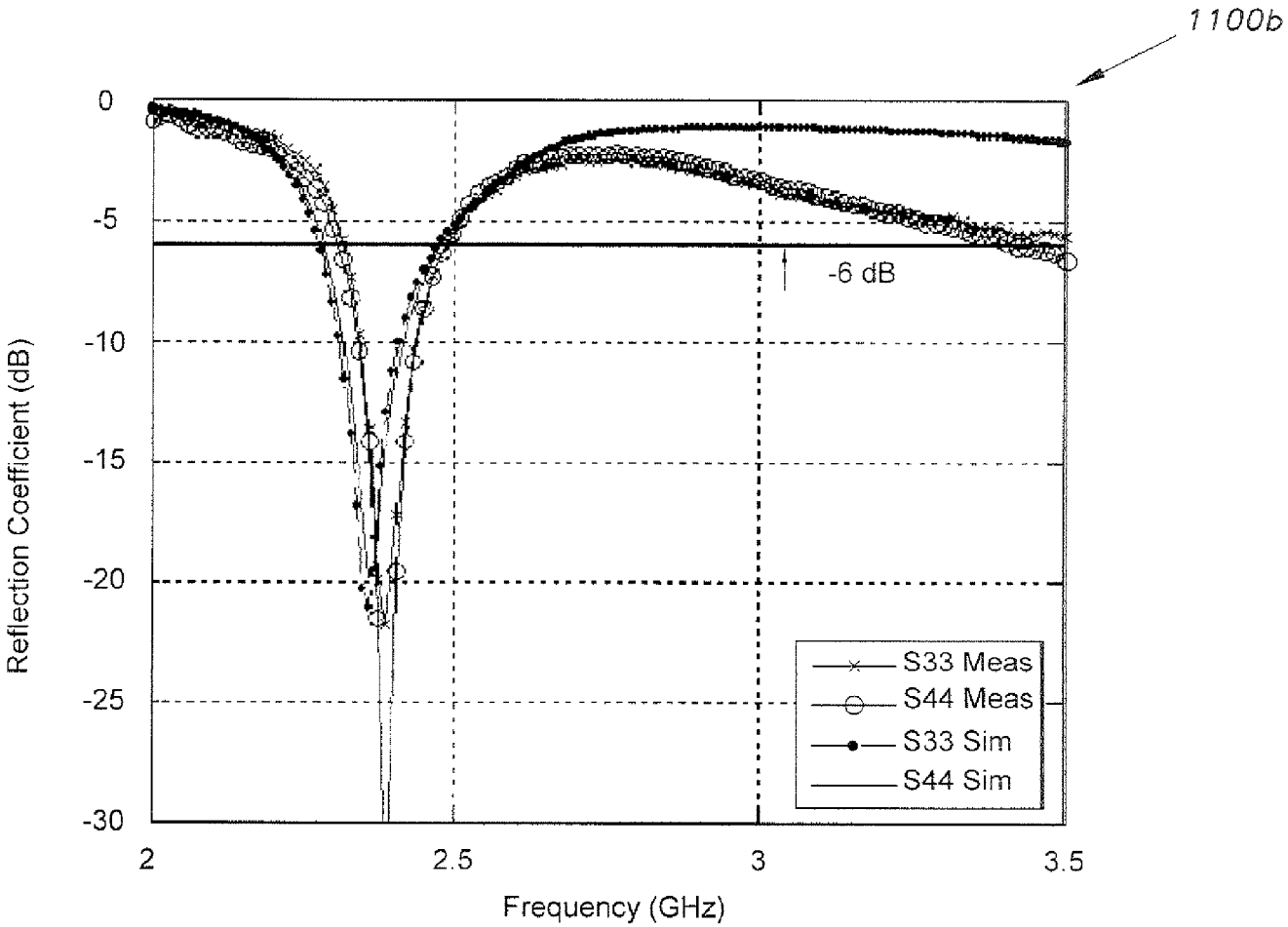
FIG. 11B is a plot showing S33 and S44 reflection coefficients for all elements of the 2×2 MIMO antenna of FIGS. 9A and 9B for the high band.

As shown in FIGS. 8 and 9B, in an alternative embodiment, the dual-band MIMO antenna system may comprise four antennas 10*a*, 10*b*, 10*c*, and 10*d* disposed over four quadrants on the top surface 812*a* of the antenna board. This configuration defines a 2×2 MIMO antenna system 805. The total length T1 of the antenna board provides sufficient space for the 2×2 MIMO antenna configuration. As shown in FIG. 9A, this design includes a cross-shaped planar copper strip 824 that forms the ground plane on the bottom surface 812*b* of the antenna board. The size of each antenna element is 29×55 $mm^2$ and the total size of the 2×2 MIMO antenna system 805 is 58×110 $mm^2$. All the antenna elements have the same dimensions. Table 3 shows the different parameter values for the model, the parameter values being optimized for best bandwidth and isolation performance. The antenna is resonant in the 700 MHz and the 2400 MHz bands.

TABLE 3

Parameter values for Antenna Elements for 2 × 2 MIMO Antenna

| Parameter | Value | Parameter | Value |
|---|---|---|---|
| Wg | 55 mm | Xf | 5 mm |
| Lg | 29 mm | Xs | 1.5 mm |
| Wg2 | 7 mm | Wt | 2.6 mm |
| Lg1 | 5 mm | h1 | 3 mm |
| Ll | 43 mm | H | 2 mm |
| L2 | 11 mm | D | 1.56 mm |
| Lf | 19.6 mm | Ws | 1 mm |
| Xa2 | 2.5 mm | Wf | 2.2 mm |

As can be seen in FIG. 9A, three vertical slits 813 (6×1.2 $mm^2$) separated by 1.8 mm have been etched from the horizontal ground plane of each antenna element. These slits modify the current distribution on the ground plane, and hence improve the bandwidth and isolation properties.

Figure 12A:
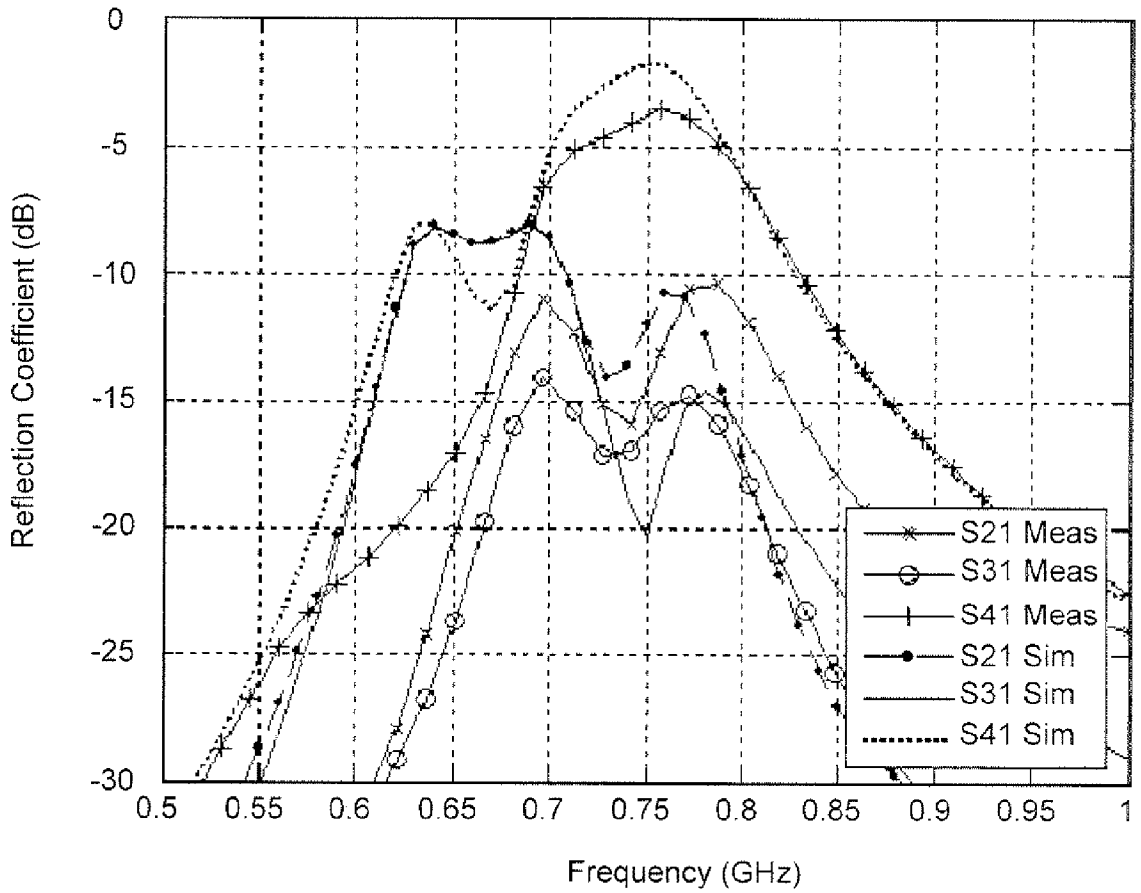
FIG. 12A is a plot showing S[21, 31, 41] isolation for all elements of the 2×2 MIMO antenna of FIGS. 9A and 9B for the low band.
Figure 12B:
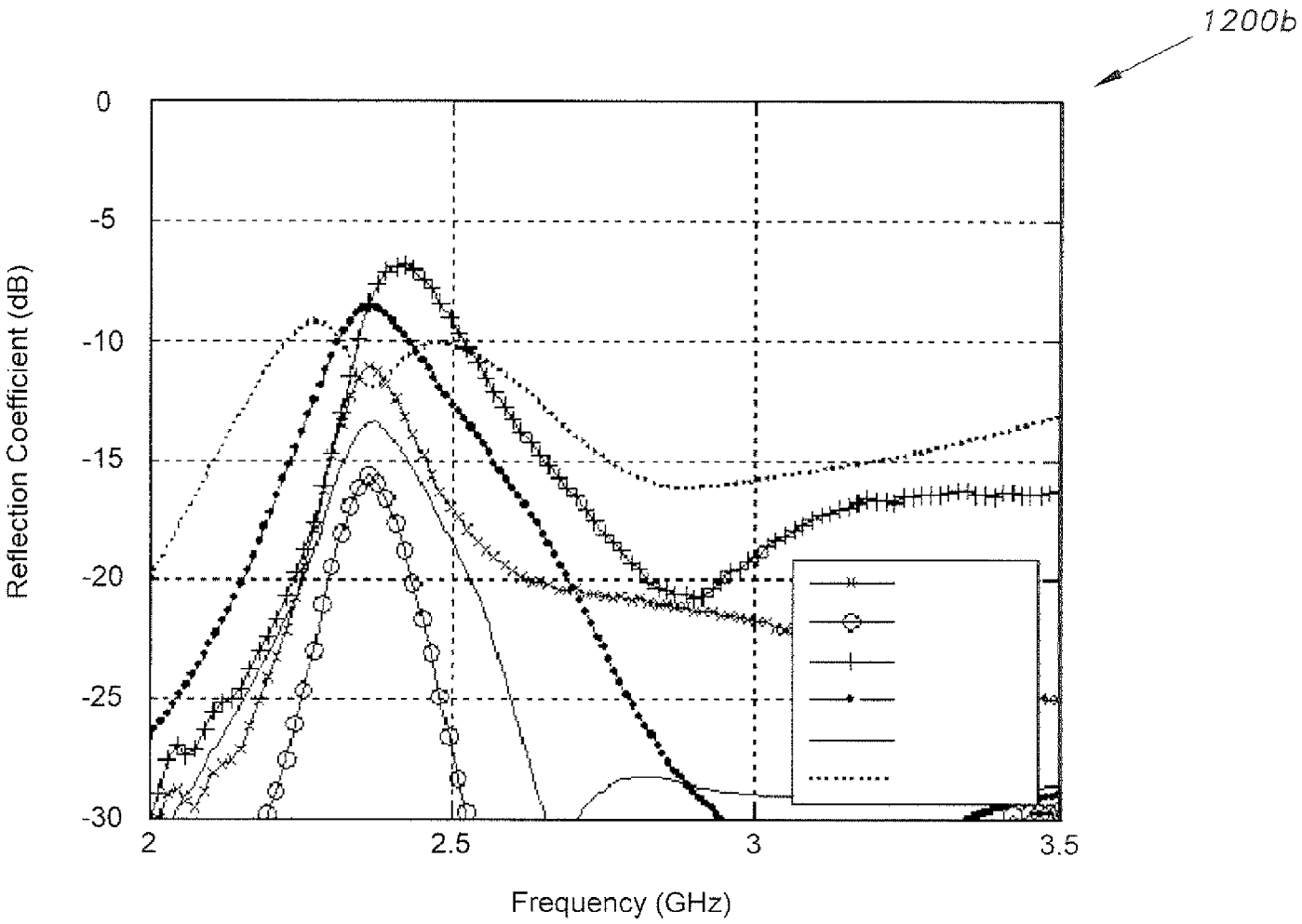
FIG. 12B is a plot showing S[21, 31, 41] isolation for all elements of the 2×2 MIMO antenna of FIGS. 9A and 9B for the high band.
Figure 13A:
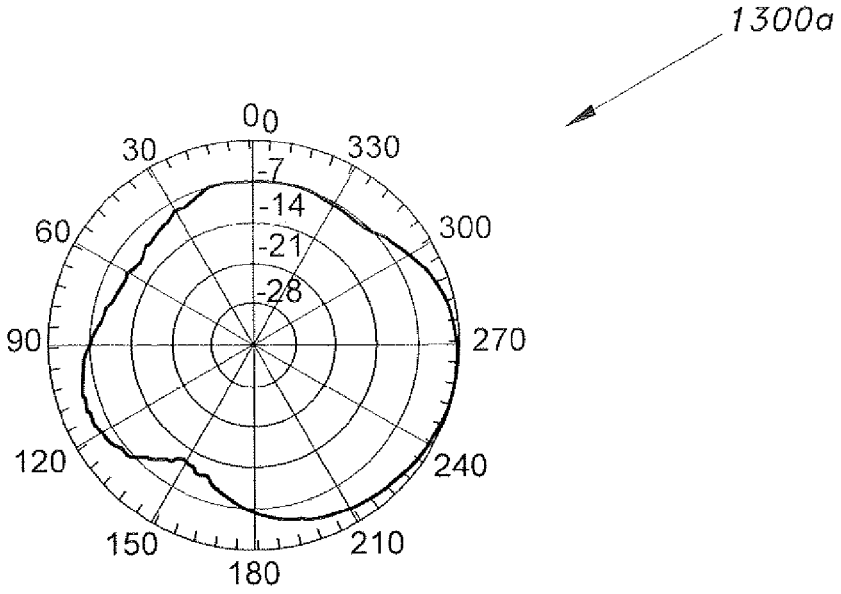
FIG. 13A is a plot showing x-z (elevation plane) radiation pattern of antenna 1 for the 2×2 MIMO antenna system of FIGS. 9A and 9B for 770 MHz.
Figure 13B:
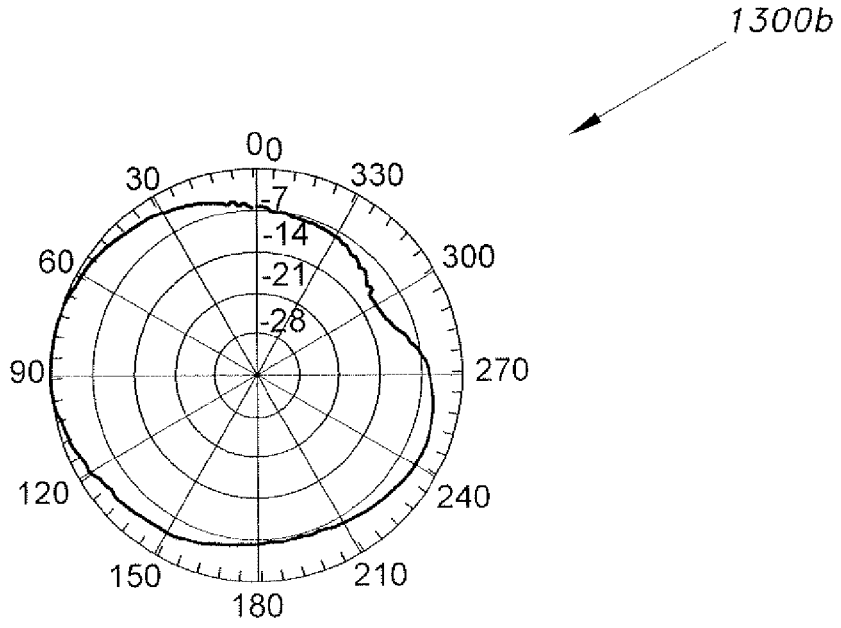
FIG. 13B is a plot showing x-z (elevation plane) radiation pattern of antenna 2 for the 2×2 MIMO antenna system of FIGS. 9A and 9B for 770 MHz.
Figure 14A:
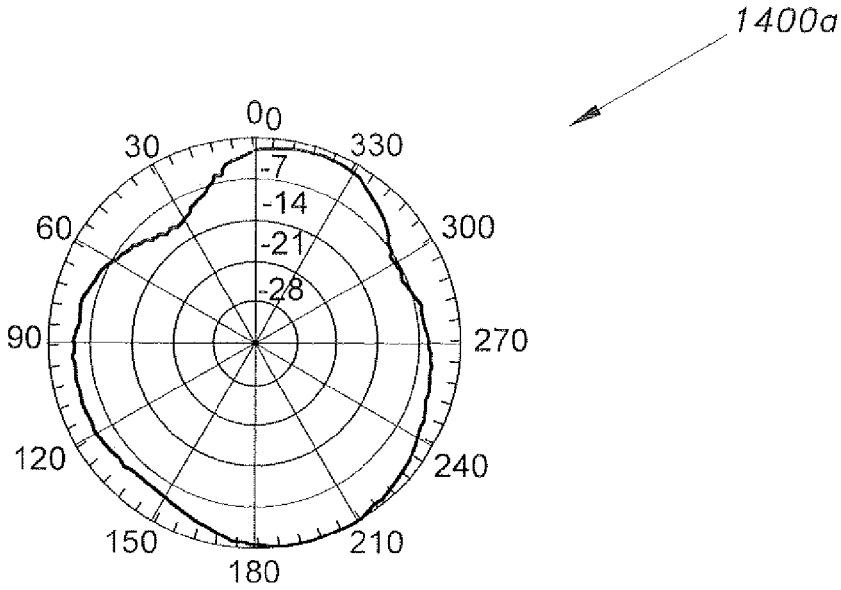
FIG. 14A is a plot showing x-y (azimuth plane) radiation pattern of antenna 1 for the 2×2 MIMO antenna system of FIGS. 9A and 9B for 770 MHz.
Figure 14B:
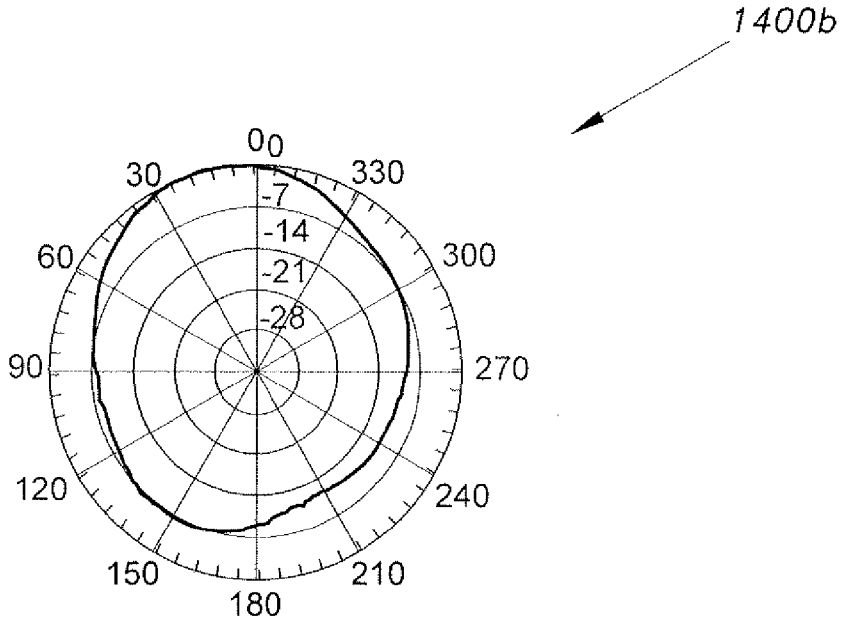
FIG. 14B is a plot showing x-y (azimuth plane) radiation pattern of antenna 2 for the 2×2 MIMO antenna system of FIGS. 9A and 9B for 770 MHz.

The simulated and measured S-parameters for the 2×2 MIMO antenna system 805 (1.56 mm substrate) are shown in FIGS. 10A-10B and FIGS. 11A-11B for the low band (700 MHz) and the high band (2400 MHz), respectively. Isolation plots 1200*a* and 1200*b* shown in FIGS. 12A and 12B illustrate the simulated and measured isolation between antenna elements at the lower and higher bands, respectively. The normalized gain patterns 1300*a*, 1300*b* and 1400*a*, 1400*b* are shown in FIGS. 13A-13B and FIGS. 14A-14B for the elevation and azimuth planes, respectively. This model gives low resonant frequencies and good reflection coefficients and bandwidths at both the low and the high bands. The −6 dB BW at the lower band is about 100 MHz (except for antenna element 4, for which the value is 62 MHz), covering the band 694-794 MHz. The −10 dB BW is about 30 MHz. At the high band, the −6 dB BW is more than 163 MHz, covering the band 2312-2475 MHz, while the −10 dB BW is more than 92 MHz. Table 4 summarizes the measurement results of 2×2 MIMO system 805. In Table 4, "Antenna Element" 1 refers to antenna 10*a* of FIG. 9B, "Antenna Element" 2 refers to antenna 10*b* of FIG. 9B, "Antenna Element" 3 refers to antenna 10*d* of FIG. 9B, and "Antenna Element" 4 refers to antenna 10*c* of FIG. 9B.

TABLE 4

Measurement Results for the 2 × 2 MIMO Antenna

| Parameter/ Model | Band | Antenna Element | BW (−6 dB) | BW (−10 dB) | $S_{xx}$ | $S_{21}$ | $S_{31}$ | $S_{41}$ | fc |
|---|---|---|---|---|---|---|---|---|---|
| 2 × 2 | Low | 1 | 100 | 28 | −13 | −10 | −15 | −3.5 | 744 |
| MIMO | | 2 | 103 | 32 | −14.5 | | | | 745 |
| Model | | 3 | 98 | 32 | −13.5 | | | | 741 |
| (1.56 mm) | | 4 | 62 | 32 | −15.5 | | | | 765 |
| | High | 1 | 177 | 100 | −17 | −11 | −15.5 | −7 | 2406 |
| | | 2 | 163 | 92 | −23 | | | | 2394 |
| | | 3 | 173 | 92 | −22 | | | | 2404 |
| | | 4 | 180 | 98 | −30 | | | | 2397 |

It should be understood that the antenna configurations described herein cover any variation or combination thereof, including variations or combinations of the herein described reference plane isolation enhancement techniques. Moreover, the antennas described herein also apply to any antenna geometry that falls within the range of frequencies and is based on printed elements in a small area for wireless systems with MIMO capability.

It is to be understood that the present invention is not limited to the embodiments described above, but encompasses any and all embodiments within the scope of the following claims.

We claim:

1. A dual-band MIMO antenna system, comprising:

a substantially rectangular planar dielectric substrate having a top face and a bottom face;

a plurality of electrically conductive microstrip antennas disposed on the substantially planar substrate, each of the antennas having:

a first elongate vertical element;

an elongate horizontal element having a first end and a second end, the first elongate vertical element extending from the first end of the elongate horizontal element such that said first elongate vertical element and said elongate horizontal element define a substantially L-shaped member;

a second elongate vertical element extending from the elongate horizontal element proximate the second end of the elongate horizontal element parallel to and in the same direction as the first elongate vertical element, the second elongate vertical element being shorter than the first elongate vertical element;

first and second stubby vertical elements extending from the elongate horizontal element proximate the second elongate vertical element in a direction opposite the second elongate vertical element, the first stubby element being an electrical feed element adapted for connection to a transmitter or receiver, the second stubby element being an electrical short element wherein said first stubby vertical element is connected between said first and second elongate vertical elements such that said first stubby vertical element is not vertically aligned with either of said first and second elongate vertical elements, said second stubby vertical element being horizontally spaced apart from the second end of the elongate horizontal element; and a ground plane disposed on the bottom face of the planar substrate, the ground plane being a continuous planar strip having a horizontal portion extending parallel to the elongate horizontal elements and a vertical portion extending parallel to and between the first elongate vertical elements, the short element being shorted to the ground plane.

2. The dual-band MIMO antenna system according to claim 1, wherein said plurality of antennas consists of two antennas arranged in mirror image from each other on said rectangular planar dielectric substrate.

3. The dual-band MIMO antenna system according to claim 2, wherein said ground plane is substantially T-shaped, thereby providing each of the antennas with an L-shaped ground plane.

4. The dual-band MIMO antenna system according to claim 1, wherein said plurality of antennas consists of a first pair of antennas arranged in mirror image to each other disposed over two lower quadrants of said planar substrate, and a second pair of antennas arranged in mirror image to each other disposed over two upper quadrants of said planar substrate.

5. The dual-band MIMO antenna system according to claim 4, wherein said ground plane is substantially cross-shaped, thereby providing each of the antennas with an L-shaped ground plane.

6. The dual-band MIMO antenna system according to claim 5, wherein said cross-shaped ground plane has a plurality of vertically extending slits extending into said ground plane proximate a center portion of the horizontally extending portion of said ground plane.

7. The dual-band MIMO antenna system according to claim 1, wherein said plurality of antennas is tuned to resonate in the 700 MHz band and also in the 2400 MHz band.

8. The dual-band MIMO antenna system according to claim 1, further comprising a plurality of coaxial cable connectors, each of the electrical feed elements having a corresponding one of the coaxial cable connectors connected thereto.

* * * * *